12/2/86 XR 4,626,740

United States Patent [19]

Fitzpatrick

[11] Patent Number: 4,626,740

[45] Date of Patent: Dec. 2, 1986

[54] RED LUMINESCENT CATHODE RAY DEVICE WITH IMPROVED COLOR FILTERING SYSTEM

[75] Inventor: Brian J. Fitzpatrick, Ossining, N.Y.

[73] Assignee: North American Philips Corporation, New York, N.Y.

[21] Appl. No.: 659,103

[22] Filed: Oct. 9, 1984

[51] Int. Cl.[4] ..... H01J 31/00; H01J 29/10; H01J 5/16

[52] U.S. Cl. ..... 313/478; 313/468; 313/112; 350/312

[58] Field of Search ..... 358/250, 253; 313/478, 313/468, 480, 474, 112; 350/312; 252/582

[56] References Cited

U.S. PATENT DOCUMENTS

| | | | |
|---|---|---|---|
| 3,143,683 | 8/1964 | Duncans | 358/253 |
| 3,631,284 | 12/1971 | Sisneros | 313/468 |
| 3,634,711 | 1/1972 | Barber | 313/468 |
| 3,638,060 | 1/1972 | Wacher | 252/582 |
| 3,914,010 | 10/1975 | Zeller | 350/312 |
| 4,070,101 | 1/1978 | Richards et al. | 350/312 |
| 4,099,883 | 7/1978 | Berger et al. | 252/582 |
| 4,106,857 | 8/1978 | Snitzer | 252/582 |

FOREIGN PATENT DOCUMENTS

| | | | |
|---|---|---|---|
| 0042361 | 4/1977 | Japan | 313/474 |

*Primary Examiner*—David K. Moore
*Assistant Examiner*—M. Razavi
*Attorney, Agent, or Firm*—Norman N. Spain

[57] ABSTRACT

Undesired light radiations emitted by europium activated red luminescent phosphors employed in projection color televisions are greatly reduced, with essentially no reduction in the desired radiation, by employing as a filter a solution containing a soluble holmium salt and a soluble neodymium salt.

12 Claims, 3 Drawing Figures

RED LUMINESCENT CATHODE RAY DEVICE WITH IMPROVED COLOR FILTERING SYSTEM

BACKGROUND OF THE INVENTION

This invention relates to a new and novel CRT device for generating a bright red light spot of a type that is particularly useful for projection color television and for information display.

Red light radiation for use in a projection color television generally is produced by the electronic bombardment of red luminescent europium-activated phosphors. The phosphors when excited by electronic bombardment produce a high amount of the desired radiation with a peak at 620 nm. However, a significant amount of radiation is produced in the 580 to 600 nm region and the 620 to 660 nm region in addition to the desired main peak at 610 nm.

As a result of this undesired radiation there is some dilution of the desired radiation. Because of the presence of the undesired radiation blurring of the image may occur when the 610 nm radiation image is brought into focus due to the chromatic aberration of the lens system.

Several methods have been proposed for filtering of undesired radiation from color television tubes. For example, Denki, Japanese Pat. No. 57180859 shows the use of a glass filter plate containing $Nd_2O_3$ and a small amount of $Cr_2O_3$ or $Pr_2O_3$. Seward et al, U.S. Pat. No. 4,086,089 employs glass faceplates for color television tubes, which faceplates function as filters. The faceplates of Seward contain $Na_2O$, F, AgHal and $SiO_2$. The Dutch Octrooi, 144063 shows an salt optical filter employing a lanthanum salt or a lanthanum oxide.

However, the filtering means disclosed in these patents have not been found to be capable of substantially reducing undesired radiation surrounding the desired 610 nm radiation peak without significantly reducing the desired 610 nm radiation peak.

BRIEF SUMMARY OF THE INVENTION

A principle object of this invention is to provide a cathode ray tube (CRT) device for generating a brilliant red light spot in which there is a significant reduction in the radiation from undesired areas surrounding the desired radiation at 610 nm and there is no significant reduction of the desired radiation peak at 610 nm. Another object of this invention is to provide an externally-liquid cooled CRT device for generating a bright red light spot for projection television and information displays in which troublesome radiations in the 580 to 600 nm region and the 620 to 660 nm region are significantly reduced without significant reduction at the desired radiation peak at 610 nm.

These and other objects of the invention will be apparent from the description that follows.

According to the invention, the applicant has developed a new and novel CRT device for generating a bright red light spot employing a europium-activated luminescent material capable of emitting red radiation with a maximum of about 610 nm excited by electrons and in which device, there is positioned outside of the faceplate of the tube envelope of the CRT and in the path of the red radiation, a transparent light filtering means comprising a concentrated solution of a mixture of a neodymium salt and a holmium salt. Quite unexpectedly it is found light emitted from the CRT device of this radiation exhibits drastically reduced radiation in the 580 to 600 nm region and the 620 to 660 nm region with practically no decrease in the desired radiation peak at 610 nm. As a result, the projected red image is more deeply saturated and of improved sharpness.

DESCRIPTION OF THE PREFERRED EMBODIMENTS

Any soluble holmium salt and soluble neodymium salt may be employed. Examples of neodymium salts that may be employed are bromide, chloride, iodide and nitrate. Examples of the holmium salts that may be employed are the holmium chloride, iodide and the nitrate. Preferably, the solutions contain above 40 to 75 grams of the holmium salt and 75 grams of the neodymium salt per 100 ml of solvent. The total concentration of the holmium and the neodymium salt preferably should not exceed 120 grams per 100 ml of solvent.

As a solvent a combination of water and an alcohol may be employed. Examples of alcohols that may be employed are ethylene glycol, 1, 2 propanediol, 1, 3-propanediol, glycerol, ethanol, propanol, isopropanol, and methanol.

Preferably to up to 80% by weight of the solvent consists of the alcohol for in such a case the solution not only acts as a filtering medium but is an excellent coolant for the tube during operation, while rendering the tube resistant to freezing during storage.

Most preferably, the solvent is 50% by weight of ethylene glycol and 50% by weight of water.

If the solution is to function not only to suppress undesired radiation but also as a coolant for the tube, the solution is preferably carried on the external surface of the faceplate and is held in place by a glass plate or other transparent member sealed to the external surface of the faceplate. However, if no cooling effect is desired, the solution need not be carried directly on the faceplate of the CRT tube but may be contained in a container located outside of the external surface of the faceplate along as the container is in the path of the radiation emitting from the tube and is transparent to the radiation of the tube.

Preferably the index of refraction of the container matches that of the faceplate.

Examples of the red emitting phosphors that may be employed in the CRT device of the invention are $Y_2O_3$:Eu, $YVO_4$:Eu, $YVO_3$:Eu, and $Y_2O_2S$:Eu. The phosphor material may be present in the cathode ray tube as an luminescent screen coated on the inner surface of the faceplate but may also be in the form of a single self-supporting crystal only the surface of which is activated.

Figure 1:
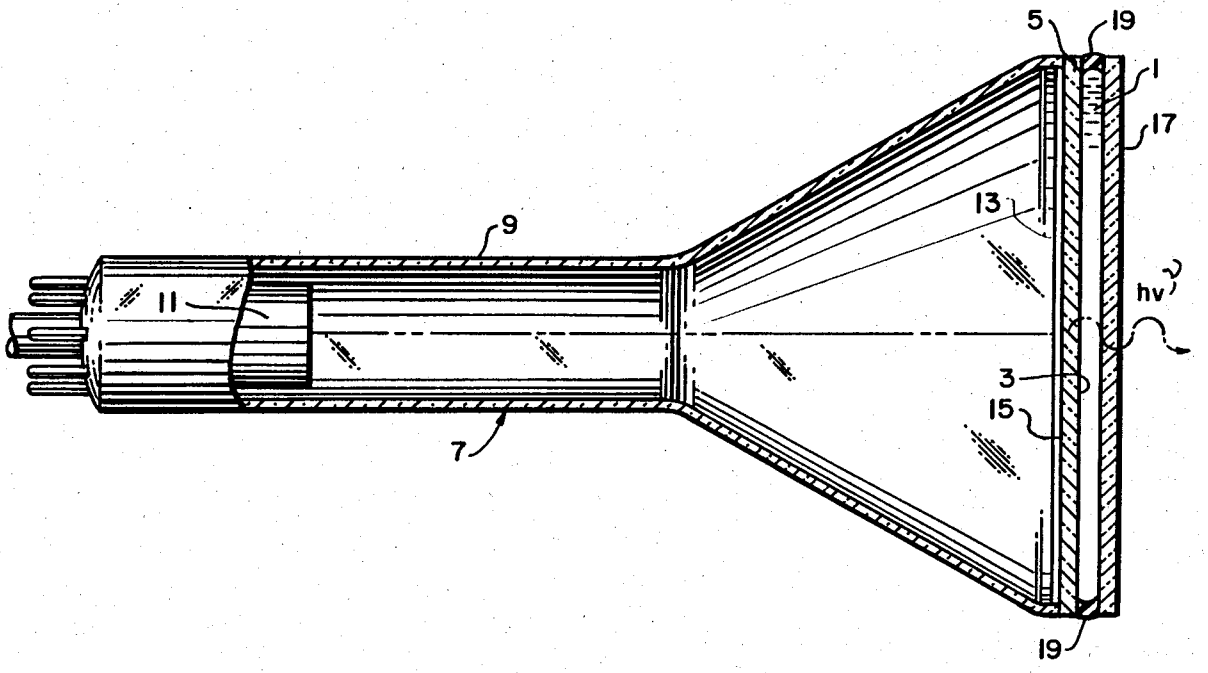
FIG. 1 is a cross-sectional view of a CRT device of the invention.

For a more complete understanding of the invention, the invention will now be described in greater detail with reference to FIG. 1 of the drawing which is a cross-sectional view of a preferred embodiment of the CRT device of the invention.

A solution of 12 grams of $Ho(NO_3)\cdot 5H_2O$ and 12 grams of $Nd(NO_3)_3\cdot 5H_2O$ in 20 ml of 50% $H_2O$: 50% ethylene glycol was prepared. A 0.5 cm thick layer of the resultant light-filtering solution 1 was prepared and applied to the external surface 3 of the glass plate 5 of a cathode ray tube 7 supplied with an envelope 9 and containing an electron gun 11 positioned to emit a beam of electrons impinging on the surface of a red luminescent screen 13 formed of a $Y_2O_3$:Eu phosphor deposited on the internal surface 15 of the faceplate.

The solution layer 1 is held in place on the external surface 3 of the faceplate 5 by transparent cover plate 17 and seals 19.

Figure 2:
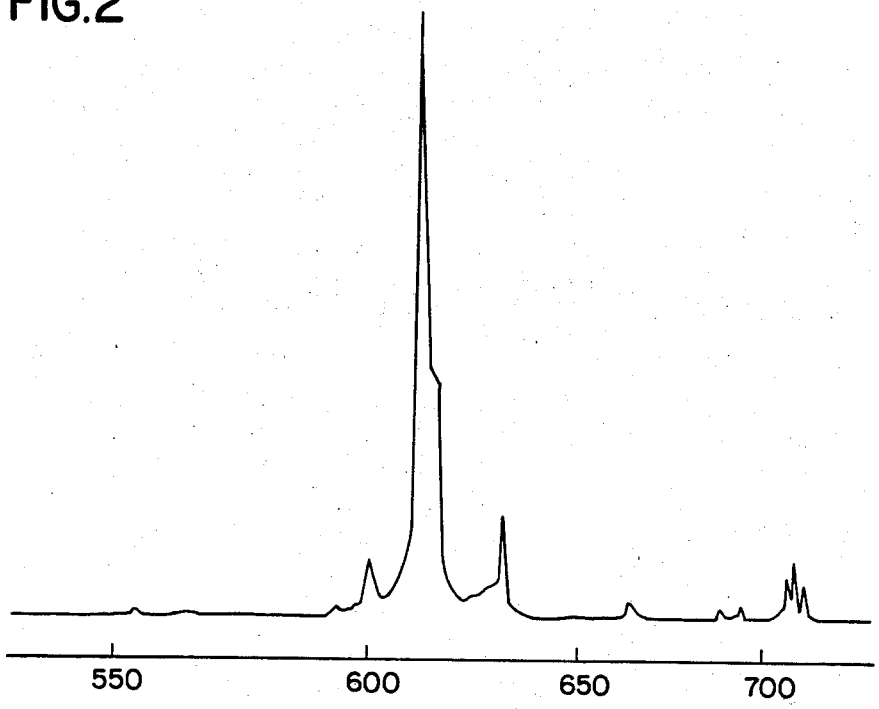
FIG. 2 is of the spectral energy distribution of the radiation emitted from a CRT device of the invention in the range of 500–750 nm and FIG. 3 is a graph showing the spectral energy distribution of the radiation emitted from an identical CRT device without the light-filtering means of the invention, also in the range of 500–750 nm.

The light output of the CRT device upon excitation of the luminescent screen by an impinging electron beam was scanned with a monochrometer in a wavelength range of 500–750 nm to record the result as is shown in the graph of FIG. 2 of the drawing in which the wavelength in nanometers (nm) is plotted on the abscissa and the measured intensity in arbitrary units on the ordinate. In a similar fashion, the light output produced by the identical CRT device except for the omission of the holmium and the neodymium salt in the coolant solution was scanned in the same wavelength range. This result is shown in the curve of the graph of FIG. 3 of the drawing.

Figure 3:
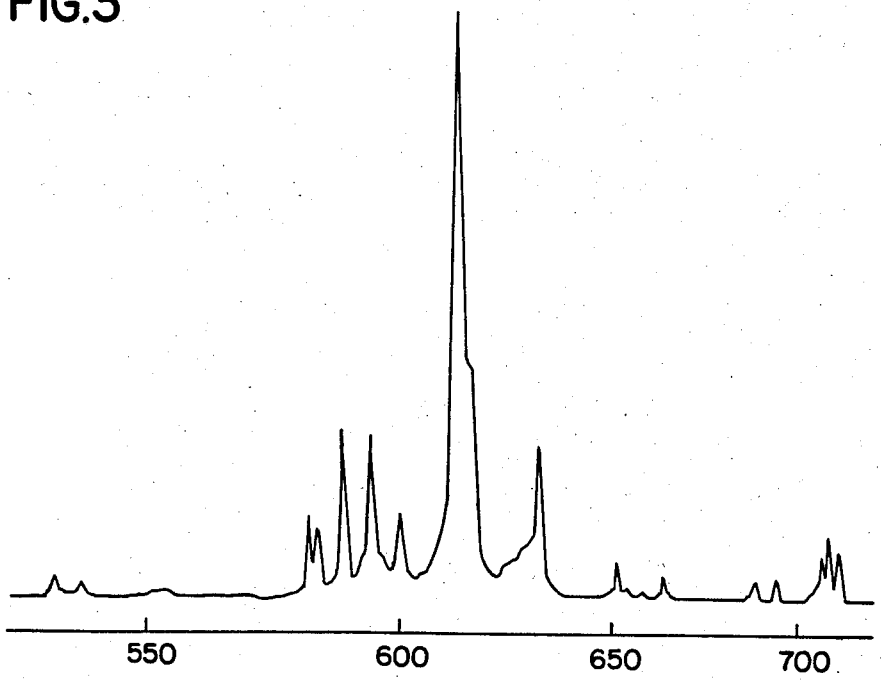

Comparison of the results in the graphs of FIG. 2 and FIG. 3 of the drawing shows the filtering solution containing the combination of the holmium and neodymium salts produces a significant decrease in the undesired radiation while leaving the desired 610 nm radiation peak virtually unchanged.

While the present invention has been described with reference to particular embodiment thereof, it should be understood that numerous modifications can be made with those familiar with the state of the art without actually departing from the scope of the invention.

What I claim:

1. A cathode ray tube device, particularly for projection television, for generating a bright red light spot comprising:

a cathode ray tube including an evacuated envelope, a europium-activated phosphor, capable of emitting red radiation when excited by electrons, positioned within said envelope and in a path of said electron beam and a transparent faceplate forming part of said envelope and positioned in the path of said red radiation, and outside of the outer surface of said faceplate, a light beam filtering means comprising a container, which at least in the path of said red radiation is transparent to said radiation, containing a concentrated solution of a soluble holmium salt and a soluble neodymium salt.

2. The cathode ray tube device of claim 1, wherein the solution solvent is a mixture of water and an alcohol selected from the group consisting of ethylene glycol, 1,2-propanediol, 1,3-propanediol, methanol, ethanol, propanol, isopropanol, and benzyl alcohol, and mixtures thereof.

3. The cathode ray tube device of claim 2, wherein the solution contains 40–75 grams each of the holmium salt and the neodymium salt per 100 ml of solvent with the total amount of the salts not being in excess of 120 grams per 100 ml of solvent.

4. The cathode ray tube device of claim 3, wherein the phosphor is a europium-activated phosphor selected from the group consisting of $Y_2O_3$:Eu, $YVO_3$:Eu, $Y_2O_2S$:Eu and $YVO_4$:Eu.

5. The cathode ray tube device of claim 4, wherein the solvent is a mixture of water and up to 80% by weight of ethylene glycol.

6. The cathode ray tube device of claim 5 wherein neodymium salt is the nitrate.

7. The cathode ray tube device of claim 5 wherein the holmium salt is the nitrate.

8. The cathode ray tube device of claim 5 wherein the solvent is a mixture of equal parts by weight of water and ethylene glycol.

9. The cathode ray tube device of claim 1 wherein the light-filtering means is sealed to the outer surface of the faceplate.

10. The cathode ray tube device of claim 2 wherein the film light-filtering means is sealed to the outer surface of the faceplate.

11. The cathode ray tube device of claim 3 wherein the light-filtering means is sealed to the outer surface of the faceplate.

12. The cathode ray tube device of claim 5 wherein the light-filtering means is sealed to the outer surface of the faceplate.

* * * * *